US011201426B2

(12) United States Patent
Kwok et al.

(10) Patent No.: US 11,201,426 B2
(45) Date of Patent: Dec. 14, 2021

(54) ELECTRICAL CONTACT APPEARANCE AND PROTECTION

(71) Applicant: Apple Inc., Cupertino, CA (US)

(72) Inventors: Raymund W. M. Kwok, Hong Kong (HK); Hani Esmaeili, Santa Clara, CA (US); Robert Scritzky, Sunnyvale, CA (US); Michael W. Barnstead, Pleasanton, CA (US); Xiaoqiang Huang, Suzhou (CN); Ida Y. Lo, Emerald Hills, CA (US); Sean R. Novak, Campbell, CA (US); Christoph Werner, San Jose, CA (US)

(73) Assignee: Apple Inc., Cupertino, CA (US)

( * ) Notice: Subject to any disclaimer, the term of this patent is extended or adjusted under 35 U.S.C. 154(b) by 36 days.

(21) Appl. No.: 16/540,013

(22) Filed: Aug. 13, 2019

(65) Prior Publication Data

US 2020/0052425 A1 Feb. 13, 2020

Related U.S. Application Data

(60) Provisional application No. 62/718,306, filed on Aug. 13, 2018.

(51) Int. Cl.

| | |
|---|---|
| ***H01R 13/03*** | (2006.01) |
| ***H01R 13/02*** | (2006.01) |
| ***H01B 1/02*** | (2006.01) |
| ***H01B 1/24*** | (2006.01) |
| ***H01B 1/22*** | (2006.01) |

(52) U.S. Cl.

CPC ..... *H01R 13/03* (2013.01); *H01B 1/026* (2013.01); *H01B 1/22* (2013.01); *H01B 1/24* (2013.01); *H01R 13/025* (2013.01)

(58) Field of Classification Search

CPC ..... H01R 13/03; H01R 13/025

See application file for complete search history.

(56) References Cited

U.S. PATENT DOCUMENTS

| | | | | |
|---|---|---|---|---|
| 3,594,493 A * | 7/1971 | Kauffman | H05K 3/284 | 174/261 |
| 5,015,602 A * | 5/1991 | Van Der Plas | H01L 21/76229 | 438/424 |
| 5,860,818 A * | 1/1999 | Sakaki | H01L 21/486 | 174/264 |
| 6,251,791 B1 * | 6/2001 | Tsai | H01L 21/31144 | 257/E21.252 |

(Continued)

OTHER PUBLICATIONS

Stöber Process, Wikipedia, [on-line], retrieved from the Internet, [retrieved on May 27, 2020], <URL: https://en.wikipedia.org/wiki/Stöber_process>, 8 pages.

(Continued)

*Primary Examiner* — Abdullah A Riyami
*Assistant Examiner* — Nader J Alhawamdeh
(74) *Attorney, Agent, or Firm* — Kilpatrick Townsend & Stockton, LLP

(57) ABSTRACT

Methods of coating contacts to have a specific color. The color can be selected to match a color of a portion of a device enclosure for an electronic device housing the contacts. Examples can instead provide methods of coating contacts to have a color to contrast with a color of a portion of the device enclosure. These methods can provide electrical contacts having a low contact resistance and good corrosion and scratch resistance.

20 Claims, 13 Drawing Sheets

(56) References Cited

U.S. PATENT DOCUMENTS

| | | | | |
|---|---|---|---|---|
| 7,547,504 | B2 * | 6/2009 | Sreenivasan | B82Y 10/00 216/44 |
| 8,191,246 | B1 * | 6/2012 | Luo | G01R 1/06716 29/842 |
| 8,500,985 | B2 * | 8/2013 | Mayer | C25F 5/00 205/205 |
| 9,517,331 | B2 * | 12/2016 | Yaegashi | A61N 1/0428 |
| 9,899,757 | B2 * | 2/2018 | Do | H01R 13/08 |
| 10,400,347 | B2 * | 9/2019 | Nishikawa | C25D 7/00 |
| 10,411,379 | B2 * | 9/2019 | Wagman | H01R 13/40 |
| 10,707,627 | B2 * | 7/2020 | Nasiri Mahalati | H02J 50/10 |
| 2004/0127073 | A1 * | 7/2004 | Ochiai | H01R 43/16 439/66 |
| 2007/0014695 | A1 * | 1/2007 | Yue | B01L 3/502707 422/400 |
| 2007/0238324 | A1 * | 10/2007 | Ho | H01R 13/22 439/66 |
| 2008/0171452 | A1 * | 7/2008 | Yakabe | G01R 3/00 439/66 |
| 2012/0178255 | A1 * | 7/2012 | Yang | H01L 21/7684 438/653 |
| 2012/0310143 | A1 * | 12/2012 | Yaegashi | A61N 1/0428 604/20 |
| 2017/0025560 | A1 * | 1/2017 | Peters | H01L 31/1864 |
| 2017/0069995 | A1 * | 3/2017 | Do | H01R 13/42 |
| 2017/0271800 | A1 * | 9/2017 | Wagman | H01R 13/40 |
| 2018/0298510 | A1 * | 10/2018 | Nishikawa | C25D 3/12 |
| 2019/0103693 | A1 * | 4/2019 | Barnstead | H01R 13/03 |
| 2020/0052425 | A1 * | 2/2020 | Kwok | H01R 13/03 |

OTHER PUBLICATIONS

Fibonacci Number, Wikipedia, [on-line], retrieved from the Internet, [retrieved on May 27, 2020], <URL: https://en.wikipedia.org/wiki/Fibonacci_number>, 18 pages.

* cited by examiner

RANDOMIZATION TABLE

| Point | X | Y |
|---|---|---|
| 1 | 5 | 5 |
| 2 | -4 | 5 |
| 3 | 1 | -2 |
| 4 | -4 | 5 |
| 5 | 4 | -5 |
| 6 | 0 | 3 |
| 7 | -3 | 2 |
| 8 | 3 | 1 |
| 9 | -1 | -5 |
| 10 | 5 | 5 |
| 11 | -1 | 1 |
| 12 | -1 | 1 |
| 13 | -5 | 5 |
| 14 | 3 | -4 |
| 15 | -4 | 3 |
| 16 | 1 | 1 |
| 17 | 2 | -1 |
| 18 | -2 | -5 |
| 19 | 2 | 1 |
| 20 | -5 | 4 |
| 21 | 2 | -5 |
| 22 | 0 | -5 |
| 23 | 1 | 3 |
| 24 | -4 | -2 |
| 25 | 5 | 1 |
| 26 | -4 | 5 |
| 27 | -2 | -5 |
| 28 | -3 | -4 |
| 29 | 4 | 3 |
| 30 | -5 | 5 |
| 31 | -5 | -3 |
| 32 | -3 | -1 |

FIG. 9

ELECTRICAL CONTACT APPEARANCE AND PROTECTION

CROSS REFERENCES TO RELATED APPLICATIONS

This application claims the benefit of U.S. Provisional Patent Application No. 62/718,306, filed on Aug. 13, 2018, which is incorporated by reference.

BACKGROUND

The number of types of electronic devices that are commercially available has increased tremendously the past few years and the rate of introduction of new devices shows no signs of abating. Devices such as tablets, laptops, netbooks, desktops, all-in-one computers, smart phones, storage devices, portable media players, wearable computing devices, navigation systems, monitors, and others, have become ubiquitous.

These electronic devices often include one or more connector receptacles through which they can provide and receive power and data. Power and data can be conveyed over cables that include a connector insert at each end of a cable. The connector inserts can be inserted into receptacles in the communicating electronic devices. In other electronic systems, contacts on a surface of first device can be in direct contact with contacts on a second device without the need for an intervening cable.

Contacts on a surface of an electronic device can be positioned in a highly visible location. As such, their appearance can be a reflection of the quality and care with which the electronic device has been made. Located where they are, these contacts can further be susceptible to exposure to liquids or other substances that can cause corrosion or discoloration. Contacts at a surface of a device can further be subject to scratches and other types of marring.

Some of these electronic devices can be very popular and can be manufactured in great numbers. Therefore it can be desirable that these contacts be readily manufactured such that demand for the electronic devices can be met. It can also be desirable to reduce the consumption of rare or precious materials used in their manufacturing.

Thus, what is needed are electrical contacts and their methods of manufacture, where the electrical contacts have a desired appearance as well as a low contact resistance. It can also be desirable that these contacts have good corrosion protection and scratch resistance, and be readily manufactured while consuming a reduced amount of rare or precious materials.

SUMMARY

Accordingly, embodiments of the present invention can provide electrical contacts and their methods of manufacture, where the electrical contacts have a desired appearance as well as a low contact resistance. These contacts can have good corrosion protection and scratch resistance, and can be readily manufactured while consuming a reduced amount of rare or precious materials. These contacts can be located at a surface of an electronic device, at a surface of a connector insert, in a connector insert on a cable, in a connector receptacle on an electronic device, or elsewhere in a connector system.

Contacts on a surface of a device can be in highly visible location. As such, embodiments of the present invention can provide methods of coating the contacts to have a specific color. The color can be selected to match a color of a portion of a device enclosure for the electronic device housing the contacts. For example, the color of the contacts can be chosen to match a portion of the device enclosure that surrounds or is near the contacts. This can provide an electronic device where the contacts and at least a portion of the device enclosure appear to be made of the same material. This uniform appearance can enhance the perceived quality and value of the electronic device.

These and other embodiments of the present invention can instead provide methods of coating contacts to provide a color to contrast with a color of a portion of a device enclosure for the electronic device housing the contacts. This color can be a noticeable color that allows a user to quickly find the contacts for mating with contacts of a second or accessory device. This contrasting color can also be chosen to imply a manufacturing source, or to match other electronic devices, such as a second or accessory device.

In these and other embodiments of the present invention, the contacts can have a specific finish, such as a matte or gloss finish. The color can also have a level of transparency. The contacts can also have more than one color. For example, a logo or other fanciful, identifying, or other information can be conveyed by more than one color on a contact.

These and other embodiments of the present invention can provide electrical contacts having a low contact resistance. For example, these contacts can have a textured surface having patterns of raised areas or ridges. These raised areas or ridges can provide a large number of contacting points between the contacts and corresponding contacts on a second or accessory device when the contacts are mated with the corresponding contacts.

These and other embodiments of the present invention can provide electrical contacts having good corrosion and scratch resistance. For example, a coating to provide color can be placed over a surface of the contact and this additional coating can provide an amount of protection for the contact against corrosion or scratches.

These and other embodiments of the present invention can provide contacts having a layer of a silicon based polymer. The silicon based polymer can be dyed to have a specific color, for example a color to match or contrast with at least a portion of an electronic device housing the contacts. Unfortunately, a silicon-based polymer can be a poor conductor. Accordingly, embodiments of the present invention can use this coating only over a portion of a surface of a contact, while the remainder of the surface of the contact can be used to form electrical connections with corresponding contacts on corresponding connectors or devices. In these and other embodiments of the present invention, instead of a silicon-based polymer, a germanium-based polymer can be used.

More specifically, in these and other embodiments of the present invention, a plurality of holes can be formed in at least a portion a surface of a contact. These holes can leave a pattern of raised areas or ridges on the surface of the contact. One or more layers can be plated or otherwise formed on at least a portion of the surface of the contact. A layer of silicon-based polymer can be applied as a gel to at least a portion of the surface of the contact. A solvent can then optionally be sprayed or otherwise applied to the gel. The silicon based polymer can be cured such that it contracts into the holes leaving the raised areas or ridges exposed. The optional solvent can help to remove water from the gel during curing to avoid cracking. The exposed areas or ridges can form electrical pathways with a corresponding contact on a corresponding connector or device when the contact and the corresponding contact are mated.

In these and other embodiments of the present invention, the holes can be formed in various ways. A substrate of the contact can be formed of copper, copper alloy, or other material. The holes in a surface of a contact can be formed by sandblasting, chemical etching, photolithography, laser etching, stamping, coining, 3-D printing, metal-injection molding, printing, casting, or they can be formed in other ways. To avoid the appearance of lines or other artifacts in the pattern of holes, such as light or dark patches, the location of the holes can be varied or randomized. For example, a laser can have a portion of its position information for some or all of the holes varied or randomized in order to disperse straight lines or other regular or repeating patterns that might otherwise be visible. In these and other embodiments of the present invention, in order to avoid the appearance of lines, light or dark patches, or other artifacts, the depths of the holes can be varied or randomized. In these and other embodiments of the present invention, the diameter of the holes can be varied or randomized. Also, holes can be omitted from areas or regions on contacts where such holes can interfere with the assembly or operation of the contacts. For example, where contacts are located in an injection molded housing, holes can be omitted from areas or regions that are under or near the injection molded housing.

In these and other embodiments of the present invention, the holes can have various sizes and spacings. For example, the diameter of the holes can be less than 20 microns, 20-40 microns, 40 microns, 42 microns, 40-45 microns, 45 microns, 48 microns, 55 microns, 52-58 microns, or more than 60 microns. The holes can have a depth of less than 5 microns, 5-10 microns, 8 microns, 10 microns, 10-30 microns, 12 microns, 13 microns, 15 microns, 20 microns, 20-25 microns, or more than 25 microns. The holes can have a center-to-center pitch of less than 20 microns, 20-50 microns, 40 microns, 50 microns, 30-60 microns, 50 microns, 60 microns, 70 microns, 50-70 microns, or more than 70 microns. The holes can have a spacing of less than 5 microns, 5-10 microns, 10 microns, 20 microns, 10-20 microns, 15 microns, 20 microns, 25 microns, 15-25 microns, or more than 25 microns. The spacing or center-to-center pitch of the holes can be varied or randomized to avoid visible patterns formed by the holes. For example, the X and Y coordinates of the holes can be varied in a range such as a plus or minus 3, 4, 5, or more than 5 micron range. These values can be stored in a table and used to modify target information for a laser forming the holes. Light and dark spots can be reduced or removed by adjusting values in the table.

After the holes have been formed, one or more plating layers can be applied to the surface of the contact. For example, a top plate can be formed over the contact to provide corrosion and scratch protection. This top plate can be formed of rhodium-ruthenium or other material. A barrier layer can be formed over the contact before the top plate is formed to prevent discoloration of the top plate by the copper substrate. The barrier layer can be tin-copper, nickel, palladium, silver, tin-copper-nickel, copper-nickel, tin-nickel, nickel-tungsten, electroless nickel, or other material. One or more adhesion layers can be applied before or after the barrier layer, or both. These adhesion layers can be a gold flash or other layer. Other layers can also be included. For example, a layer of nickel-tungsten alloy, tin-nickel, electroless nickel, copper-nickel, silver, or other material can be plated or formed over the substrate before the barrier layer. Other combinations, such as a top plate of rhodium-ruthenium over silver, palladium, nickel, electroless nickel, a nickel-tungsten alloy, tin-nickel, tin-copper, tin-copper-nickel, copper-nickel, tin-nickel, nickel-tungsten, or other nickel alloy can be used, where one or more gold layers can be included. Layers of gold over nickel can also be used in these and other embodiments of the present invention. Additional steps, such as electro-polishing or copper plating can be performed on the substrate after the holes have been formed and before further plating to smooth areas damaged by the laser. In these and other embodiments of the present invention, these layers can be formed by sputtering, vapor deposition, electroplating, or other method. In these and other embodiments of the present invention, the order of these steps can be varied. For example, a substrate can be plated before holes are formed.

A dyed silicon-based polymer can then be applied as a gelatinous or viscous solution to one or more surfaces of the contact. The dyed silicon-based polymer can be a sol-gel, formed using a sol-gel process such as the Stöber process. In these and other embodiments of the present invention, tetraethyl orthosilicate (TEOS) can be hydrolyzed to form a silicon oxide network, which can be more generally referred to as sol-gel. In these and other embodiments of the present invention, instead of hydrolyzing, a similar process using a solvent can be employed. The sol-gel can be dyed and applied to one or more surfaces of the contact. A solvent can be applied to the sol-gel. In these and other embodiments of the present invention, both the sol-gel and the solvent can be applied by spraying, printing, or other method. After the sol-gel and optional solvent have been applied, the result can be cured. After curing, the sol-gel can contract to fill the holes, again leaving the surrounding raised portions and ridges exposed. These surrounding raised portions and ridges can then form an electrical connection with a corresponding contact when the contact and the corresponding contact are mated.

The sol-gel coated contacts can be cured or dried at room or a higher temperature. The die particles in the sol-gel can begin to aggregate as the sol-gel is cured or dried. As the curing process continues, the sol-gel can become more gelatinous and the aggregations of dyed particles can begin to themselves aggregate. The sol-gel can then become a solid as it contracts into the holes and pulls back from the raised portions and ridges. The optional solvent can help to prevent cracking and other damage to the sol-gel by removing water from the sol-gel during curing. The dried sol-gel can consume as little as eight percent of the original volume of the sol-gel.

In these and other embodiments of the present invention, instead of using a sol-gel, other materials, such as conductive ink or other types of ink can be used. In these and other embodiments of the present invention, paint can be used. For example, a polymeric paint, such as a polytetrafluoroethylene (PTFE) based paint, can be used. These inks or paints can be applied using pad printing, ink-jet printing, 3-D printing, aerosol jet printing, or other types of printing. In these and other embodiments of the present invention, the formation of holes can be optional.

While embodiments of the present invention are well-suited to electrical contacts and their method of manufacturing, these and other embodiments of the present invention can be used to improve the appearance and corrosion resistance of other structures. For example, electronic device cases and enclosures, connector housings and shielding, battery terminals, magnetic elements, measurement and medical devices, sensors, fasteners, various portions of wearable computing devices such as clips and bands, bearings, gears, chains, tools, or portions of any of these, can be covered with coatings, plating, and other layers as described herein and otherwise provided for by embodiments of the present invention. The coatings, plating, and other layers for these other structures can be formed or manufactured as described herein and otherwise provided for by embodiments of the present invention. For example, magnets and other structures for fasteners, connectors, speakers, receiver magnets, receiver magnet assemblies, microphones, and other devices can be improved by structures and methods such as those shown herein and in other embodiments of the present invention.

In various embodiments of the present invention, the contacts and their connector assemblies can be formed in various ways of various materials. For example, contacts and other conductive portions can be formed by stamping, coining, metal-injection molding, machining, micro-machining, 3-D printing, or other manufacturing process. The conductive portions can be formed of stainless steel, steel, copper, copper alloy, copper titanium, phosphor bronze, palladium, palladium silver, or other material or combination of materials, as described herein. They can be plated or coated with nickel, gold, palladium, rhodium, ruthenium, or other material, as described herein. The nonconductive portions can be formed using injection or other molding, 3-D printing, machining, or other manufacturing process. The nonconductive portions can be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention can provide contacts and their connector assemblies that can be located in, or can connect to, various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These contacts and their connector assemblies can provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning®, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these contacts can be used to convey power, ground, signals, test points, and other voltage, current, data, or other information.

Various embodiments of the present invention can incorporate one or more of these and the other features described herein. A better understanding of the nature and advantages of the present invention can be gained by reference to the following detailed description and the accompanying drawings.

BRIEF DESCRIPTION OF THE DRAWINGS

FIGS. 2-13 illustrate methods of manufacturing contacts according to embodiments of the present invention.

DESCRIPTION OF ILLUSTRATIVE EMBODIMENTS

Figure 1:
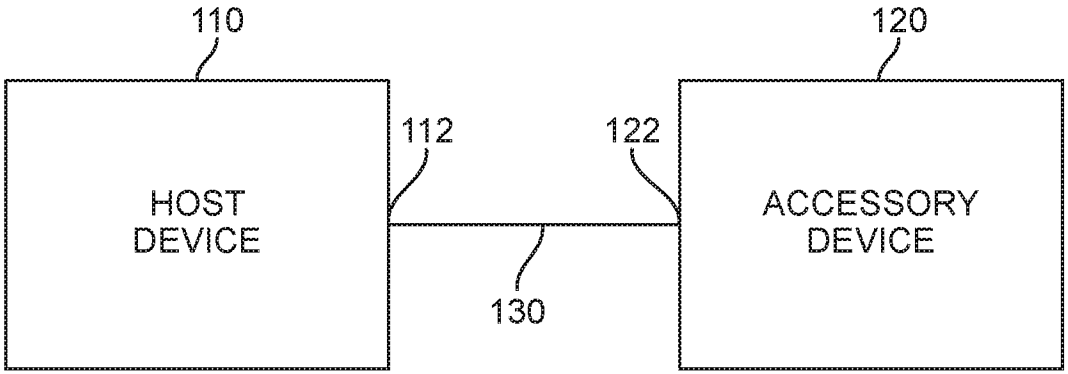
FIG. 1 illustrates an electronic system according to an embodiment of the present invention.

FIG. 1 illustrates an electronic system according to an embodiment of the present invention. This figure, as with the other included figures, is shown for illustrative purposes and does not limit either the possible embodiments of the present invention or the claims.

In this example, host device 110 can be connected to accessory device 120 in order to share data, power, or both. Specifically, electrical contacts (or more simply, contacts) 112 on host device 110 can be electrically connected to contacts 122 on accessory device 120. Contacts 112 on host device 110 can be electrically connected to contacts 122 on accessory device 120 via cable 130. In other embodiments of the present invention, contacts 112 on host device 110 can be in physical contact and directly and electrically connected to contacts 122 on accessory device 120. In still other embodiments of the present invention, one or more optical contacts (not shown) supporting one or more optical connections between host device 110 and accessory device 120 can be included with contacts 112 and 122.

To facilitate a direct connection between contacts 112 on host device 110 and contacts 122 on accessory device 120, contacts 112 on host device 110 and contacts 122 on accessory device 120 can be located on the surfaces of their respective devices. But this location can make them highly visible to users, as well as vulnerable to exposure to liquids, fluids, or other types of contaminants. This location can also make the contacts vulnerable to scratches, marring, or other damage.

Accordingly, embodiments of the present invention can provide methods of coating contacts to provide a specific color. The color can be selected to match a color of a portion of a device enclosure for the electronic device housing the contacts. For example, the color of the contacts can be chosen to match a portion of the device enclosure that surrounds or is near the contacts. This can provide an electronic device where the contacts and at least a portion of the device enclosure appear to be made of the same material. This uniform appearance can enhance the perceived quality and value of the electronic device.

These and other embodiments of the present invention can instead provide methods of coating contacts to provide a color to contrast with a color of a portion of a device enclosure for the electronic device housing the contacts. This color can be a noticeable color that allows a user to find the contacts quickly for mating with contacts of a second or accessory device. This contrasting color can also be chosen to imply a manufacturing source, or to match other electronic devices, such as a second or accessory device.

In these and other embodiments of the present invention, the contacts can have a specific finish, such as a matte or gloss finish. The color can also have a level of transparency. The contacts can also have more than one color. for example, a logo or other fanciful, identifying, or other information can be conveyed by more than one color on a contact.

These and other embodiments of the present invention can provide electrical contacts having a low contact resistance. For example, these contacts can have a textured surface having patterns of raised areas or ridges. These raised areas or ridges can provide a large number of contacting points between the contacts and corresponding contacts on a second or accessory device when the contacts are mated with the corresponding contacts.

These and other embodiments of the present invention can provide electrical contacts having good corrosion and scratch resistance. For example, a coating to provide color can be placed over a surface of the contact and this additional coating can provide an amount of protection for the contact against corrosion or scratches. Examples are shown in the following figures.

Figure 2:
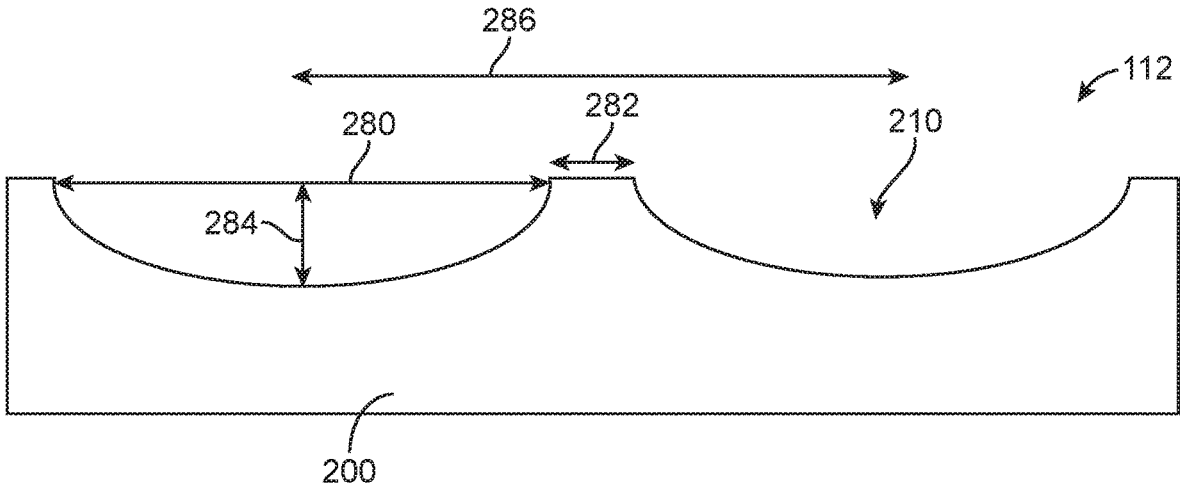

FIGS. 2-10 illustrate methods of manufacturing contacts according to embodiments of the present invention. In FIG. 2, a substrate 200 for contact 112 can be received. The substrate 200 can be for a contact 122, or other contacts in other devices. The substrate 200 of contact 112 can be formed of copper, copper alloy, or other material. A number of holes 210 can be formed in at least a portion of one or more surfaces of contact 112. These holes 210 can be formed in substrate 200 of contact 112 in various ways. Holes 210 can be sandblasted, chemically etched, formed using photolithography, laser etched, stamped, coined, 3-D printed, metal-injection molded, printed, cast, or they can be formed in other ways. To avoid the appearance of lines or other artifacts in the pattern of holes, the location of the holes can be varied or randomized. For example, a laser can have a portion of its position information for some or all of the holes varied or randomized in order to disperse straight lines or other regular patterns that might otherwise be visible.

In these and other embodiments of the present invention, the holes can have various sizes or diameters 280 and spacings 282. For example, the diameter 280 of holes 210 can be less than 20 microns, 20-40 microns, 40 microns, 42 microns, 40-45 microns, 45 microns, 48 microns, 55 microns, 52-58 microns, or more than 60 microns. Holes 210 can have a depth 284 of less than 5 microns, 5-10 microns, 8 microns, 10 microns, 10-30 microns, 12 microns, 13 microns, 15 microns, 20 microns, 20-25 microns, or more than 25 microns. Holes 210 can have a center-to-center pitch 286 of less than 20 microns, 20-50 microns, 40 microns, 50 microns, 30-60 microns, 50 microns, 60 microns, 70 microns, 50-70 microns, or more than 70 microns. Holes 210 can have a spacing 282 of less than 5 microns, 5-10 microns, 10 microns, 20 microns, 10-20 microns, 15 microns, 20 microns, 25 microns, 15-25 microns, or more than 25 microns. The spacing 282 or center-to-center pitch 286 of holes 210 can be varied or randomized to avoid visible patterns formed by the holes. For example, the X and Y coordinates of holes 210 can be varied in a range such as a plus or minus 3, 4, 5, or more than 5 micron range. These values can be stored in a table and used to vary a target for a laser forming the holes. Light and dark spots can be reduced or removed by adjusting values in the table.

Figure 3:
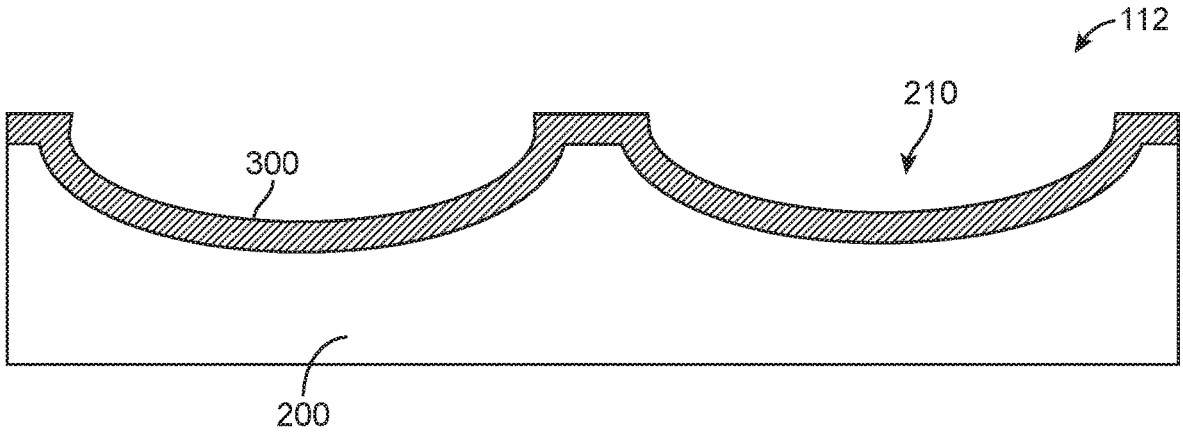

In FIG. 3, holes 210 in substrate 200 of contact 112 can be plated with one or more plating layers 300. These plating layers 300 can include a top plate that can be formed over contact 112 to provide corrosion and scratch protection. This top plate can be formed of rhodium-ruthenium or other material. A barrier layer can be formed over contact 112 before the top plate is formed to prevent discoloration of the top plate by the copper substrate 200. The barrier layer can be tin-copper, nickel, palladium, silver, tin-copper-nickel, copper-nickel, tin-nickel, nickel-tungsten, electroless nickel, or other material. One or more adhesion layers can be applied before or after the barrier layer, or both. These adhesion layers can be a gold flash or other layer. Other layers can also be included. For example, a layer of nickel-tungsten alloy, tin-nickel, electroless nickel, copper-nickel, silver, or other material can be plated or formed over the substrate before the barrier layer. Other combinations, such as a top plate of rhodium-ruthenium over silver, palladium, nickel, electroless nickel, a nickel-tungsten alloy, tin-nickel, tin-copper, tin-copper-nickel, copper-nickel, tin-nickel, nickel-tungsten, or other nickel alloy can be used, where one or more gold layers can be included. Layers of gold over nickel can be used in these and other embodiments of the present invention. Additional steps, such as electro-polishing or copper plating can be performed on the substrate after the holes have been formed and before plating to smooth areas damaged by the laser. In these and other embodiments of the present invention, these layers can be formed by sputtering, vapor deposition, electroplating, or other method. In these and other embodiments of the present invention, the order of these steps can be varied. For example, a substrate 200 can be plated before holes 210 are formed.

Figure 4:
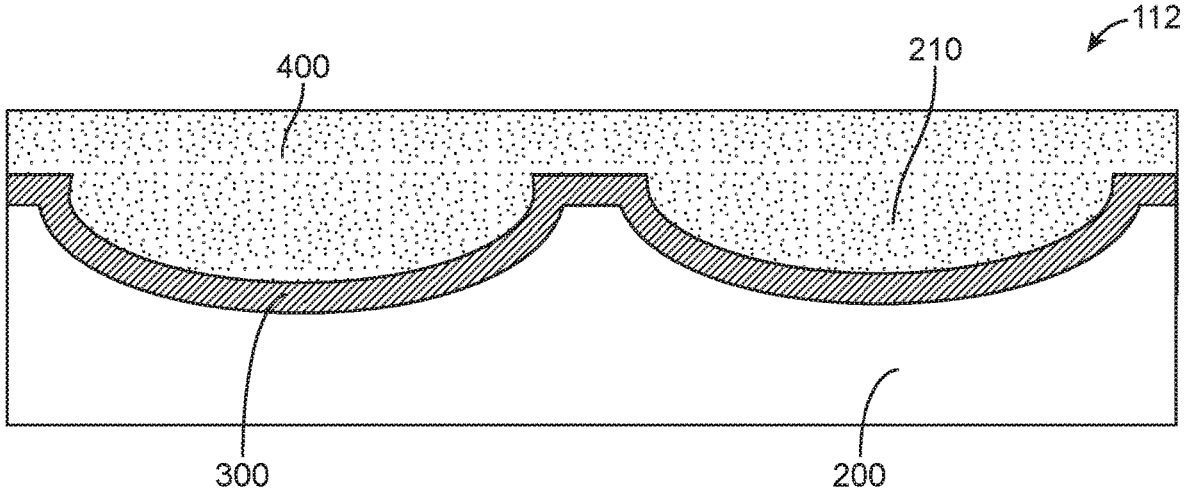

In FIG. 4, a dyed silicon-based polymer 400 can be applied as a gelatinous or viscous solution to one or more surfaces of contact 112, such as the surface of plating layers 300 on substrate 200. The dyed silicon-based polymer 400 can be a sol-gel formed using a sol-gel process such as the Stöber process. In these and other embodiments of the present invention, tetraethyl orthosilicate (TEOS) can be hydrolyzed to form a silicon oxide network, which can be more generally referred to as a sol-gel. In these and other embodiments of the present invention, instead of hydrolyzing, a similar process using a solvent can be employed. The sol-gel can be dyed and applied to at least a portion of one or more surfaces of contact 112. A solvent can then be applied to the sol-gel. Both the sol-gel and the solvent can be applied by spraying, printing, or by other method. The sol-gel can then be dried or cured. The drying or curing can take place at room or an elevated temperature. The die particles in the sol-gel can begin to aggregate as the sol-gel is dried and cured. As the curing process continues, the sol-gel can become more gelatinous and the aggregations of dyed particles can begin to themselves aggregate. The sol-gel can then become a solid as it contracts into holes 210 and pulls back from raised portions and ridges 500 (shown in FIG. 5.) The optional solvent can help to prevent cracking and other damage to the sol-gel by removing water from the sol-gel during curing. The dried sol-gel can consume as little as eight percent of the original volume of the hydrolyzed sol-gel. In these and other embodiments of the present invention, instead of a silicon-based polymer, a germanium-based polymer can be used.

Figure 5:
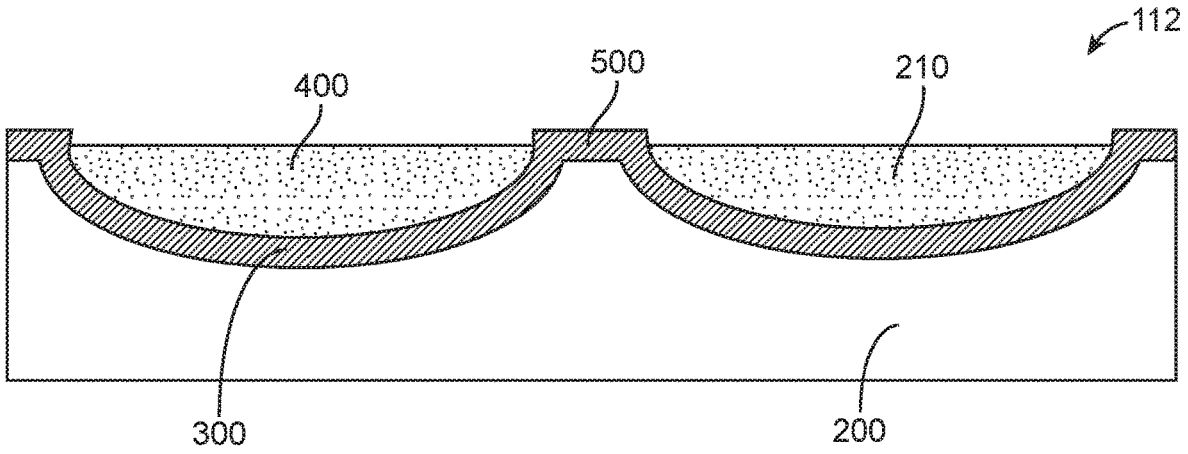

In FIG. 5, after curing, the dyed silicon-based polymer 400 or sol-gel can contract to fill holes 210, leaving the surrounding raised portions and ridges 500 exposed. That is, the surface tension of the sol-gel can pull the sol-gel away from raised portions and ridges 500 and into holes 210. These surrounding raised portions and ridges 500 (formed by plating layers 300 on substrate 200) can then form an electrical connection with a corresponding contact when contact 112 and the corresponding contact are mated.

In these and other embodiments of the present invention, instead of using a sol-gel, other materials, such as conductive ink or other types of ink can be used. In these and other embodiments of the present invention, paint can be used. For example, a polymeric paint, such as a polytetrafluoroethylene (PTFE) based paint, can be used. These inks or paints can be applied using pad printing, ink-jet printing, 3-D printing, aerosol jet printing, or other types of printing. In these and other embodiments of the present invention, the formation of holes 210 can be optional.

Figure 6:
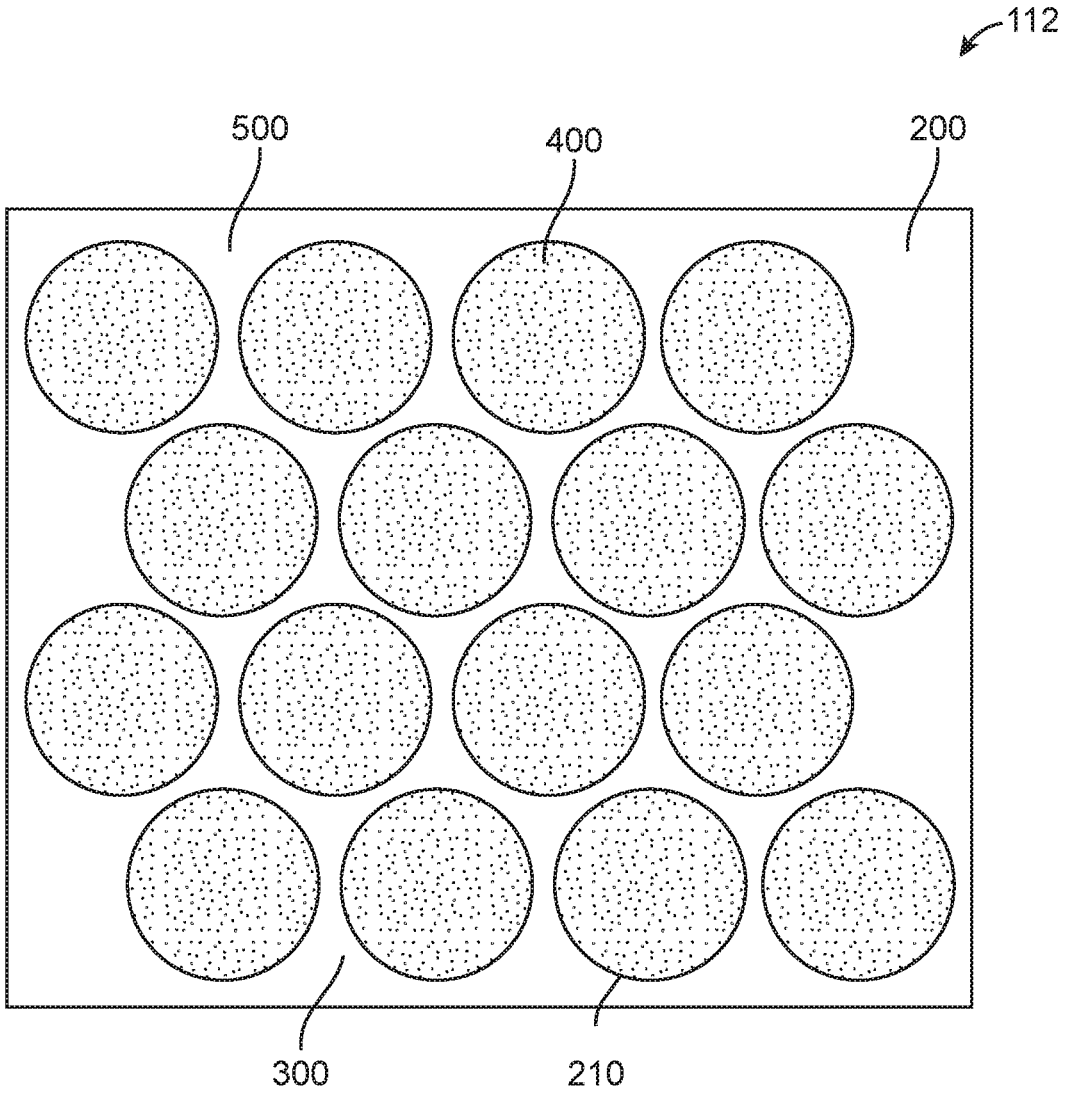
Figure 7:
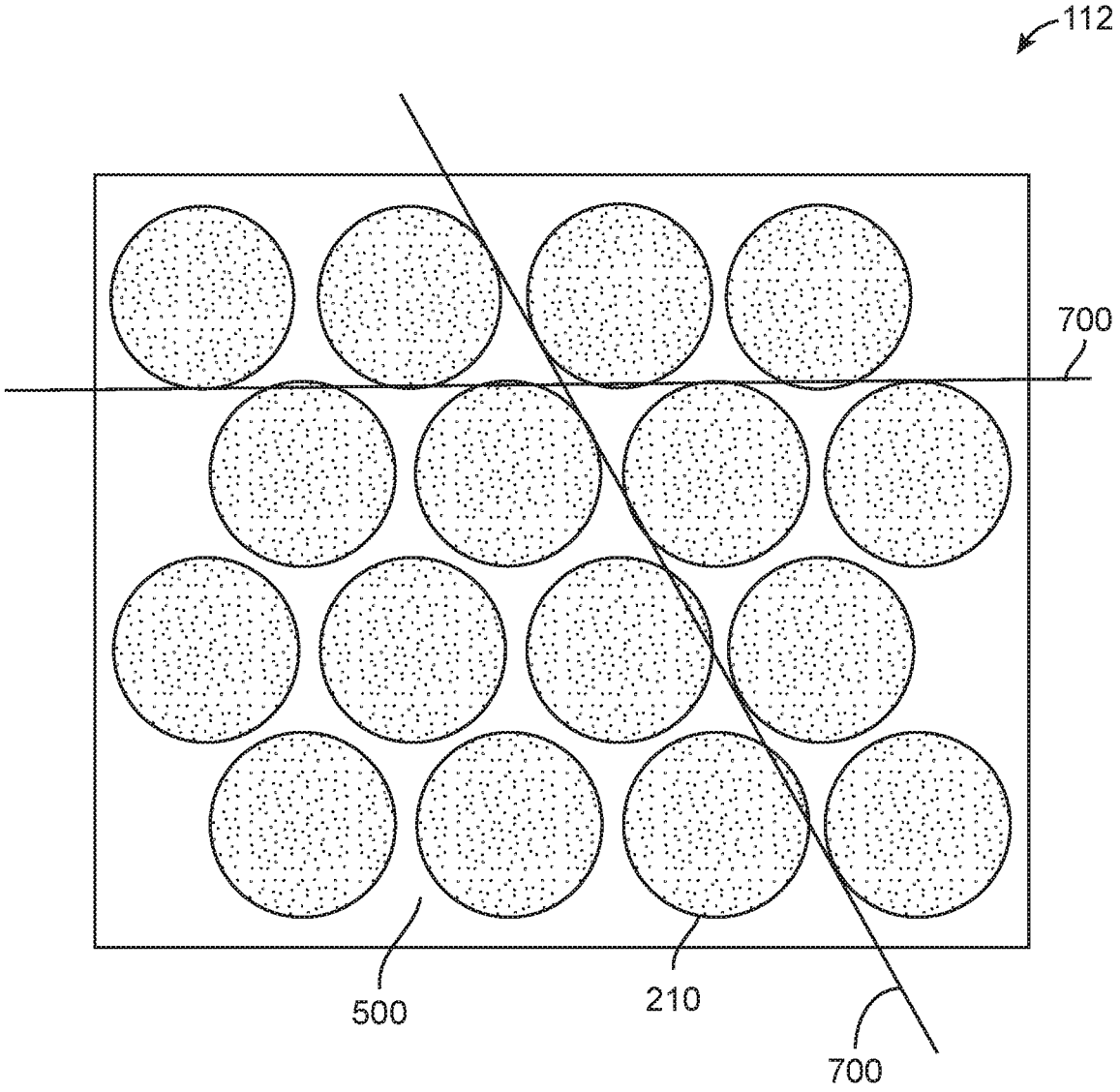

FIG. 6 is a top view of a portion of contact 112 having holes 210 filled with dried sol-gel (dyed silicon-based polymer 400) to expose surrounding raised portions and ridges 500 of plating layers 300. The pattern of holes 210 in substrate 200 can be a regular, repeating pattern of holes that can form lines of raised portions and ridges 500 that can be visible. FIG. 7 illustrates lines 700 that can be visible in a pattern of raised portions and ridges 500 formed by holes 210 in contact 112.

Figure 8:
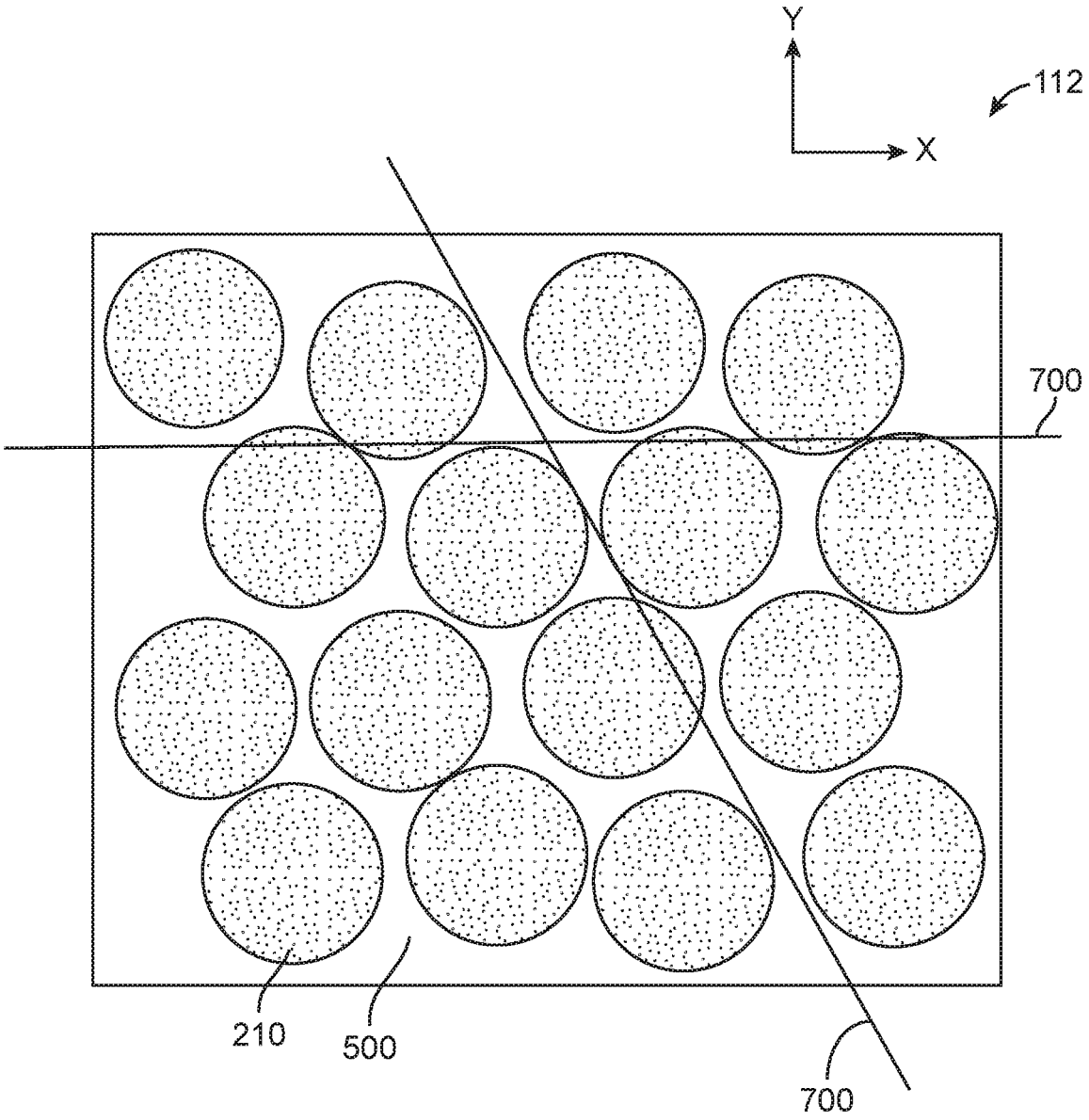

Accordingly, in FIG. 8, the X and Y coordinates of each hole 210 can be varied or randomized to reduce or eliminate lines 700 that can be formed by raised portions and ridges 500 in contact 112. That is, the X and Y coordinates for each hole can be varied from the regular, repeating pattern in FIGS. 6 and 7. For example, the X and Y coordinates of each hole can be modified by a value of −5, −4, −3, −2, −1, 0, 1, 2, 3, 4, 5 microns, where the value is read from a table stored in memory and used to vary a position of a laser forming holes 210. In this way, a laser can have a portion of its position information for some or all of holes 210 varied in order to disperse straight lines or other regular or repeating patterns that might otherwise be visible. These tables can be arranged to reduce or eliminate local light and dark regions as well. An example of such as table is shown in FIG. 9. In this table, a variance in what would otherwise be a regular, repeating pattern or array of holes is provided by X and Y values for each point. That is, each point can be a location for a hole in a regular, repeating pattern of holes. This regular, repeating pattern can be varied by moving each hole in an X direction by an amount listed in a corresponding X entry in the X column of the table and by moving each hole in a Y direction by an amount listed in a corresponding Y entry in the Y column of the table. Using these variations, a resulting pattern of holes can appear to be randomized and can have a reduced incidence of regular or repeating lines, patterns, or light or dark areas that can be observable. In these and other embodiments of the present invention, in order to avoid the appearance of lines, light or dark patches, or other artifacts, the depths of the holes can be varied or randomized. In these and other embodiments of the present invention, the diameter of the holes can be varied or randomized. Also, holes can be omitted from areas or regions on contacts where such holes can interfere with further assembly or operation of the contacts. For example, where contacts are located in an injection molded housing, holes can be omitted from areas or regions that are under or near the injection molded housing.

In these and other embodiments of the present invention, the holes can be positioned using other methods or algorithms. For example, the holes can be arranged in a honeycomb pattern, a randomized honeycomb pattern, or other honeycomb-based pattern. A randomized honeycomb pattern can be formed by starting with a honeycomb pattern and then moving each hole a randomized amount, as was done with the holes in FIG. 8 above. Other patterns, such as a pattern formed by the filling orbitals or concentric circles of holes around a center hole or center point, can be used.

The angle at which a laser, drill, or other tool forms the holes can be varied as the holes are formed. Alternatively, more than one laser can be used to form the holes, where the more than one laser are positioned at different angles relative to the contact surface. This can further reduce any observable patterns of lines, curves, or light or dark areas.

Figure 10:
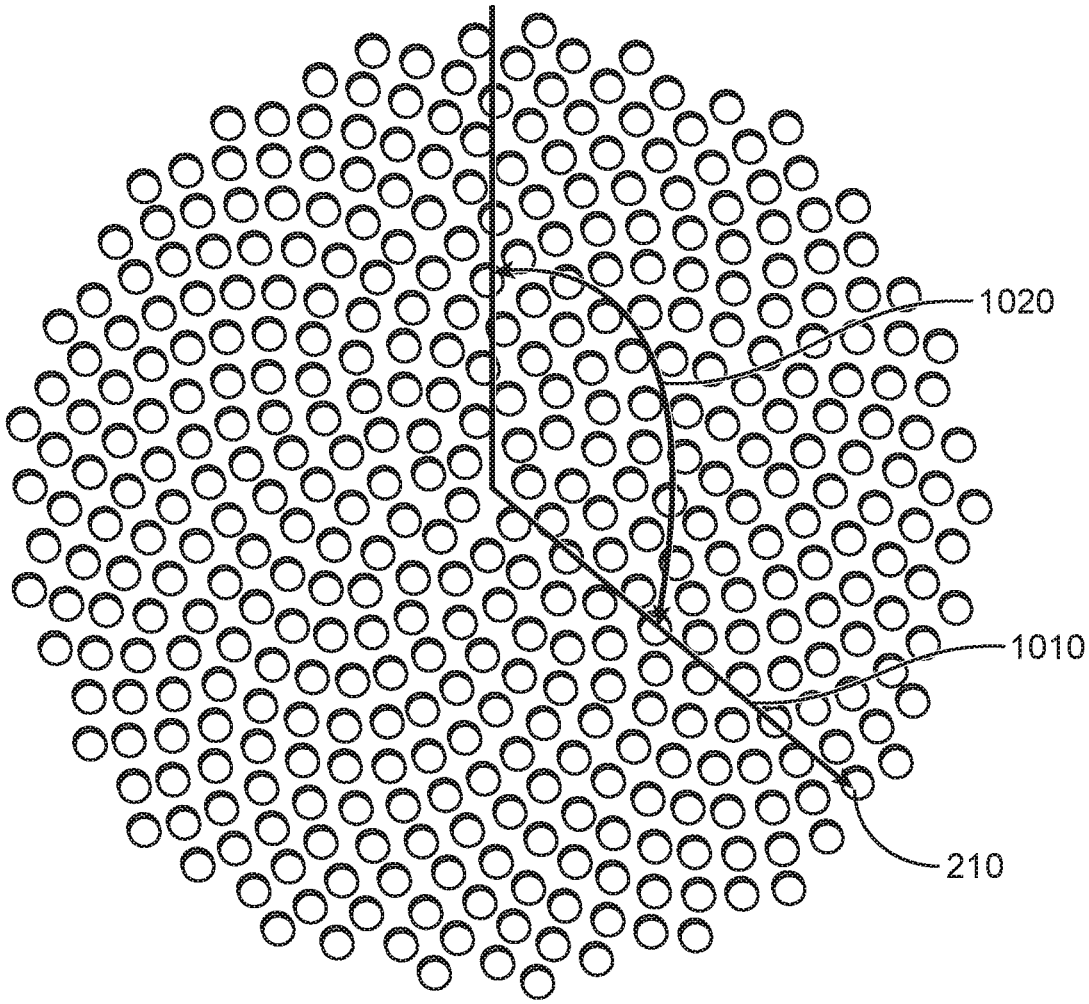

In these and other embodiments of the present invention, the holes can be positioned in a spiral pattern where the holes are arranged to provide maximum spacing. For example, the holes can be arranged in a cyclotron spiral with a constant divergence angle between successive holes. These holes can be arranged in a pattern based on a logarithmic spiral, such as a golden spiral. The holes can be arranged in an approximation of the golden spiral, such as a Fibonacci spiral. Such a spiral can be approximated with Vogel's model using the equations $$\text{radius}=c(\text{sqrt}(n))$$

and $$\text{theta}=n(137.508)$$

where the radius and the angle theta define the placement of hole n, c is a constant, and 137.508 degrees is approximately equal to the golden angle. A pattern of holes generated using this method is shown in FIG. 10. This pattern can be generated using Vogel's model and can be referred to as a Fibonacci spiral or a Fibonacci-spiral based pattern. The radius 1010 and angle theta 1020 are shown for hole 210 in FIG. 10. Other spiral patterns, such as Fermat's spiral, an Archimedean spiral, or other types of spirals or patterns can be used as well.

Figure 11:
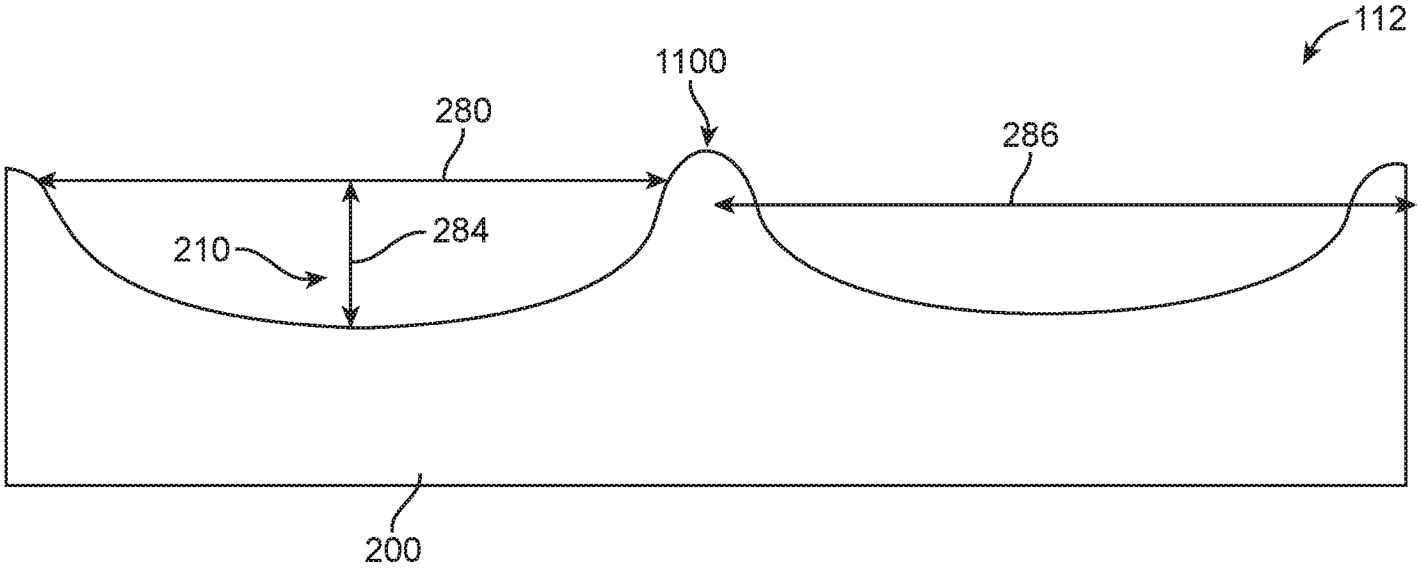

To further reduce reflections from raised portions and ridges 500 (shown in FIG. 5), the edges of the raised portions and ridges 500 can be smoothed or rounded off. For example, after holes 210 are formed in substrate 200 of contact 112, substrate 200 of contact 112 can be etched, polished, or otherwise rounded off before being plated with plating layers 300. In FIG. 11, surface 1100 has been rounded off. Holes 210 can have similar depths 284, diameters 280, and center-to-center pitches 286 as shown above.

To still further reduce reflections from raised portions and ridges 500, holes 210 can be filled with dyed silicon-based polymer 400 to a specific level. For example, a ratio between a depth of a hole 210 and a depth of dyed silicon-based polymer 400 in the hole can be adjusted to be between 1.1 and 1.4, between 1.1 and 1.5, between 1.1 and 1.6, or it can be adjusted to be in another range of values.

Figure 12:
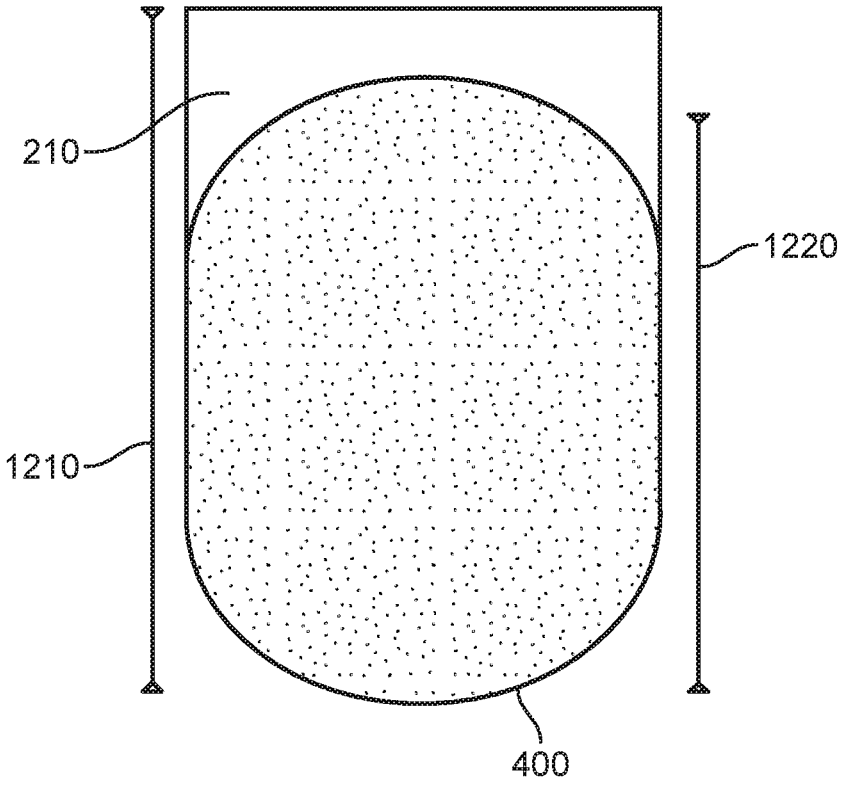

In FIG. 12, hole 210 can have a depth 1210. Hole 210 can be filled with dyed silicon-based polymer 400 to a depth 1220. The ratio of depth 1210 to depth 1220 can be between 1.1 and 1.4, between 1.1 and 1.5, between 1.1 and 1.6, or it can be adjusted to be in another range of values.

Figure 13:
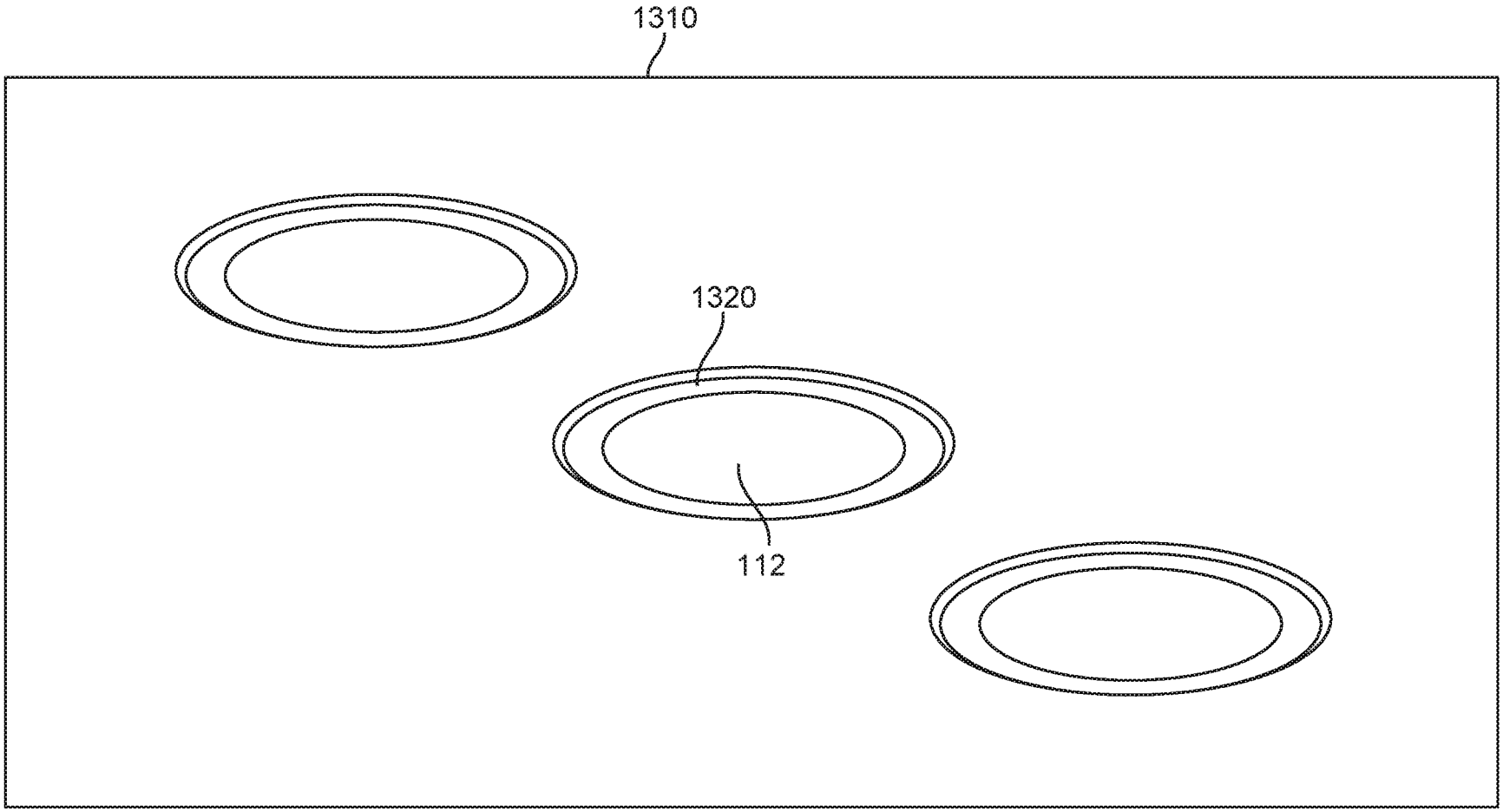

In these and other embodiments of the present invention, holes 210 can be arranged to provide a texture for contacts 112 that can match or be similar to a texture of a surrounding device enclosure 1310, as shown in FIG. 13. That is, the laser pattern can be adjusted so that the texture of contacts 112 can provide an appealing effect when contacts 112 are put together with the surrounding material of the device enclosure 1310. In these and other embodiments of the present invention, holes can be formed in the device enclosure 1310 as well as in the contacting surface of the contacts 112, or holes can be formed in the device enclosure 1310 or the contacting surfaces of the contacts 112. In these and other embodiments of the present invention, holes can be formed in any or all of the device enclosure 1310, insulating rings 1320, and the contacting surface of the contacts 112.

While embodiments of the present invention are well-suited to electrical contacts and their method of manufacturing, these and other embodiments of the present invention can be used to improve the appearance and corrosion resistance of other structures. For example, electronic device cases and enclosures, connector housings and shielding, battery terminals, magnetic elements, measurement and medical devices, sensors, fasteners, various portions of wearable computing devices such as clips and bands, bearings, gears, chains, tools, or portions of any of these, can be covered with coatings, plating, and other layers as described herein and otherwise provided for by embodiments of the present invention. The coatings, plating, and other layers for these other structures can be formed or manufactured as described herein and otherwise provided for by embodiments of the present invention. For example, magnets and other structures for fasteners, connectors, speakers, receiver magnets, receiver magnet assemblies, microphones, and other devices can be improved by structures and methods such as those shown herein and in other embodiments of the present invention. These and other embodiments of the present invention can also be used to improve the adhesion of structures. For example, a plurality of holes can be formed in a surface of an object as outlined herein. A nickel or other corrosion layer can be formed on the surface. An adhesive layer can then be applied to the surface. The holes can assist the surface to adhere to a second surface.

In these and other embodiments of the present invention, including the above contacts, other layers, such as barrier layers to prevent corrosion of internal structures can be included. For example, barrier layers, such as zinc barrier layers, can be used to protect magnets or other internal structures from corrosion by cladding or plating layers. Catalyst layers can be used to improve the rate of deposition for other layers, thereby improving the manufacturing process. These catalyst layers can be formed of palladium or other material. Stress separation layers, such as those formed of copper, can also be included in these and other embodiments of the present invention, including the above contacts. Other scratch protection, passivation, and corrosion resistance layers can also be included.

In various embodiments of the present invention, the contacts and their connector assemblies can be formed in various ways of various materials. For example, contacts and other conductive portions can be formed by stamping, coining, metal-injection molding, machining, micro-machining, 3-D printing, or other manufacturing process. The conductive portions can be formed of stainless steel, steel, copper, copper alloy, copper titanium, phosphor bronze, palladium, palladium silver, or other material or combination of materials, as described herein. They can be plated or coated with nickel, gold, palladium, rhodium, ruthenium, or other material, as described herein. The nonconductive portions can be formed using injection or other molding, 3-D printing, machining, or other manufacturing process. The nonconductive portions can be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention can provide contacts and their connector assemblies that can be located in, and can connect to, various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These contacts and their connector assemblies can provide pathways for signals that are compliant with various standards such as Universal Serial Bus (USB), High-Definition Multimedia Interface (HDMI), Digital Visual Interface (DVI), Ethernet, DisplayPort, Thunderbolt, Lightning®, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connectors can be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A method of manufacturing an electrical contact, the method comprising:

receiving a contact substrate;

forming a plurality of holes in a surface of the contact substrate, wherein the holes are formed using a laser and are separated by a pattern of raised portions, and wherein the contact substrate comprises copper;

plating the surface of the contact substrate;

applying a coating layer to the surface of the contact substrate; and curing the coating layer such that its thickness is reduced and at least some of the pattern of raised portions is exposed, wherein plating the surface of the contact substrate comprises plating the surface with copper, plating the copper plating with palladium, applying a gold flash to the palladium, and plating the gold flash with rhodium-ruthenium.

2. The method of claim 1 further comprising, before curing the coating layer, applying a layer of solvent.

3. The method of claim 1 wherein the coating layer comprises a silicon-based polymer.

4. A method of manufacturing an electrical contact, the method comprising:

receiving a contact substrate;

laser drilling a plurality of holes in a surface of the contact substrate, wherein the holes are separated by a pattern of raised portions;

applying a dyed gelatinous solution to the surface of the contact substrate; and curing the dyed gelatinous solution such that its thickness is reduced and at least some of the pattern of raised portions is exposed.

5. The method of claim 4 wherein the plurality of holes are formed at locations, where the locations are varied from a regular, repeating pattern by an amount that is varied for each hole.

6. The method of claim 5 wherein the locations of the holes in the plurality of holes are varied from a regular, repeating pattern by a first amount in a first direction and a second amount in a second direction, wherein the first amount and the second amount are varied among the holes in the plurality of holes.

7. The method of claim 5 wherein a diameter of a first hole in the plurality of holes is varied as compared to a diameter of a second hole in the plurality of holes.

8. The method of claim 5 wherein a depth of a first hole in the plurality of holes is varied as compared to a depth of a second hole in the plurality of holes.

9. The method of claim 5 wherein holes in the plurality of holes are omitted near an edge of the electrical contact.

10. An electrical contact comprising:

a contact substrate having a plurality of holes in a surface, wherein the holes are separated by a pattern of raised portions;

a plurality of plating layers over the surface of the contact substrate, wherein the plurality of plating layers comprise a barrier layer over the surface of the contact substrate and a top plate over the barrier layer; and a dyed silicon-based polymer in the plurality of holes in the surface of the electrical contact such that the pattern of raised portions is exposed.

11. The electrical contact of claim 10 wherein the barrier layer comprises palladium.

12. The electrical contact of claim 11 wherein the top plate comprises rhodium-ruthenium.

13. The electrical contact of claim 12 wherein the dyed silicon-based polymer is formed by hydrolyzing tetraethyl orthosilicate.

14. The electrical contact of claim 12 wherein the dyed silicon-based polymer is formed using the Stober process.

15. The electrical contact of claim 12 wherein the plurality of holes are arranged in a Fibonacci spiral.

16. The electrical contact of claim 10 wherein locations of the holes in the plurality of holes are varied from a regular, repeating pattern by an amount that is varied for each hole.

17. The electrical contact of claim 16 wherein the locations of the holes in the plurality of holes are varied from a regular, repeating pattern by a first amount in a first direction and a second amount in a second direction, wherein the first amount and the second amount are varied among the holes in the plurality of holes.

18. The electrical contact of claim 10 wherein holes in the plurality of holes are omitted near an edge of the electrical contact.

19. The electrical contact of claim 10 wherein the contact substrate comprises copper.

20. The electrical contact of claim 19 wherein the plurality of plating layers comprises a layer of copper, the barrier layer over the layer of copper, a gold flash over the barrier layer, and the top plate over the gold flash, and wherein the barrier layer comprises palladium and the top plate comprises rhodium-ruthenium.

* * * * *